US011702916B2

(12) United States Patent
Bolt et al.

(10) Patent No.: US 11,702,916 B2
(45) Date of Patent: Jul. 18, 2023

(54) CONTROLLING THE FLOW OF FLUID TO HIGH PRESSURE PUMPS

(71) Applicant: NATIONAL OILWELL VARCO, L.P., Houston, TX (US)

(72) Inventors: Travis Lee Bolt, Conroe, TX (US); Zachary Daniel Baker, Cleveland, TX (US); Eric O'Reilly Sears, College Station, TX (US); Jonathan Tyler Maxwell, Willis, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 17/247,769

(22) Filed: Dec. 22, 2020

(65) Prior Publication Data

US 2022/0195856 A1 Jun. 23, 2022

(51) Int. Cl.
*E21B 43/26* (2006.01)
*E21B 34/02* (2006.01)

(52) U.S. Cl.
CPC ..... *E21B 43/26* (2013.01); *E21B 34/02* (2013.01); *E21B 34/025* (2020.05); *E21B 43/2607* (2020.05)

(58) Field of Classification Search
CPC ..... E21B 43/26; E21B 34/02; E21B 34/025; E21B 43/2607
See application file for complete search history.

(56) References Cited

U.S. PATENT DOCUMENTS

| | | | |
|---|---|---|---|
| RE19,132 | E | 4/1934 | McGuirk et al. |
| 2,862,731 | A | 12/1958 | Hedden et al. |
| 2,937,444 | A | 5/1960 | Kern |
| 3,458,219 | A | 7/1969 | Wesch |
| 3,572,380 | A | 3/1971 | Jackson et al. |
| 3,752,507 | A | 8/1973 | Maurer et al. |
| 3,776,578 | A | 12/1973 | Jessup et al. |
| 4,354,698 | A | 10/1982 | Linder et al. |
| 4,391,297 | A | 7/1983 | Knight |
| 4,496,176 | A | 1/1985 | Weinhold |
| 4,844,133 | A | 7/1989 | Von Meyerinck et al. |
| 5,577,775 | A | 11/1996 | Pearson et al. |
| 5,738,178 | A | 4/1998 | Williams et al. |

(Continued)

FOREIGN PATENT DOCUMENTS

| | | | |
|---|---|---|---|
| CA | 2605260 | C | 6/2011 |
| CN | 109025944 | A | 12/2018 |

(Continued)

OTHER PUBLICATIONS

"U.S. Appl. No. 16/214,930, Non-Final Office Action dated Jan. 26, 2021", 16 pgs.

(Continued)

*Primary Examiner* — James G Sayre
(74) *Attorney, Agent, or Firm* — Schwegman Lundberg & Woessner, P.A.

(57) ABSTRACT

A hydraulic fracturing system can include valve apparatuses that control the delivery of fluid to high-pressure pumps that supply the fluid to a wellhead. The valve apparatuses can receive electronic signals from a control system to regulate the flow rate of the fluid to the high-pressure pumps. In one or more examples, the flow rate of the fluid can be controlled such that proppant in the fluid remains in solution.

20 Claims, 4 Drawing Sheets

(56) References Cited

U.S. PATENT DOCUMENTS

| | | | | |
|---|---|---|---|---|
| 7,007,753 | B2 | 3/2006 | Robichaux et al. | |
| 7,654,583 | B2 | 2/2010 | Kvamme et al. | |
| 8,146,665 | B2 | 4/2012 | Neal | |
| 8,590,556 | B2 | 11/2013 | Kendrick | |
| 10,408,031 | B2 | 9/2019 | Oehring et al. | |
| 2004/0094898 | A1 | 5/2004 | Zheng | |
| 2009/0041588 | A1 | 2/2009 | Hunter et al. | |
| 2010/0310384 | A1 | 12/2010 | Stephenson et al. | |
| 2010/0320699 | A1 | 12/2010 | Takeda et al. | |
| 2012/0060929 | A1 | 3/2012 | Kendrick | |
| 2012/0099954 | A1 | 4/2012 | Teichrob et al. | |
| 2013/0284455 | A1 | 10/2013 | Kajaria et al. | |
| 2014/0023463 | A1 | 1/2014 | Oren | |
| 2014/0041317 | A1 | 2/2014 | Pham et al. | |
| 2014/0048158 | A1 | 2/2014 | Baca et al. | |
| 2014/0290768 | A1 | 10/2014 | Randle et al. | |
| 2015/0000766 | A1 | 1/2015 | Arizpe et al. | |
| 2015/0060044 | A1* | 3/2015 | Scharmach | B01F 35/2134 166/68 |
| 2015/0336747 | A1 | 11/2015 | Teichrob et al. | |
| 2016/0102537 | A1 | 4/2016 | Lopez | |
| 2016/0160889 | A1 | 6/2016 | Hoffman et al. | |
| 2016/0170403 | A1 | 6/2016 | Lopez et al. | |
| 2017/0074074 | A1 | 3/2017 | Joseph et al. | |
| 2017/0291780 | A1 | 10/2017 | Sherwood et al. | |
| 2017/0334639 | A1 | 11/2017 | Hawkins et al. | |
| 2018/0045331 | A1* | 2/2018 | Lopez | F17D 1/04 |
| 2018/0187507 | A1 | 7/2018 | Hill et al. | |
| 2018/0223640 | A1 | 8/2018 | Keihany et al. | |
| 2018/0283151 | A1 | 10/2018 | Cook et al. | |
| 2018/0284817 | A1 | 10/2018 | Cook et al. | |
| 2018/0298731 | A1 | 10/2018 | Bishop | |
| 2019/0169971 | A1 | 6/2019 | Oehring et al. | |
| 2019/0211814 | A1* | 7/2019 | Weightman | F04B 49/065 |
| 2020/0182385 | A1 | 6/2020 | Westgarth et al. | |
| 2020/0355321 | A1* | 11/2020 | Zerkus | F16K 3/0254 |
| 2021/0040830 | A1* | 2/2021 | Mu | E21B 44/00 |
| 2021/0354910 | A1 | 11/2021 | Grimes et al. | |
| 2021/0396223 | A1* | 12/2021 | Yeung | G01L 3/00 |

FOREIGN PATENT DOCUMENTS

| | | | |
|---|---|---|---|
| CN | 113167420 | A | 7/2021 |
| EP | 1872047 | A2 | 1/2008 |
| GB | 1258305 | A | 12/1971 |
| GB | 2341653 | A | 3/2000 |
| WO | WO-2013/095123 | A1 | 6/2013 |
| WO | 2017039692 | A1 | 3/2017 |
| WO | WO-2018/074995 | A1 | 4/2018 |
| WO | 2019112554 | A1 | 6/2019 |
| WO | 2019147603 | A1 | 8/2019 |
| WO | WO-2020/056360 | A1 | 3/2020 |
| WO | WO-2020/120512 | A1 | 6/2020 |
| WO | WO-2021/003178 | A1 | 1/2021 |
| WO | WO-2021/003179 | A1 | 1/2021 |

OTHER PUBLICATIONS

"U.S. Appl. No. 16/214,930, Response filed Dec. 7, 2020 to Restriction Requirement dated Oct. 7, 2020", 6 pgs.
"U.S. Appl. No. 16/214,930, Restriction Requirement dated Oct. 7, 2020", 10 pgs.
"International Application Serial No. PCT/EP2019/084518, International Search Report dated Mar. 9, 2020", 5 pgs.
"International Application Serial No. PCT/EP2019/084518, Written Opinion dated Mar. 9, 2020", 7 pgs.
"International Application Serial No. PCT/US2019/051158, International Preliminary Report on Patentability dated Sep. 30, 2020", 4 pgs.
"International Application Serial No. PCT/US2019/051158, International Search Report dated Jan. 6, 2020", 4 pgs.
"International Application Serial No. PCT/US2019/051158, Invitation to Pay Additional Fees dated Oct. 28, 2019", 2 pgs.
"International Application Serial No. PCT/US2019/051158, Response filed Jul. 13, 2020 to Written Opinion dated Jan. 6, 2020", 3 pgs.
"International Application Serial No. PCT/US2019/051158, Written Opinion dated Jan. 6, 2020", 6 pgs.
"International Application Serial No. PCT/US2020/040336, International Search Report dated Sep. 25, 2020", 3 pgs.
"International Application Serial No. PCT/US2020/040336, Written Opinion dated Sep. 25, 2020", 6 pgs.
"International Application Serial No. PCT/US2020/040338, International Search Report dated Sep. 25, 2020", 3 pgs.
"International Application Serial No. PCT/US2020/040338, Written Opinion dated Sep. 25, 2020", 6 pgs.
"U.S. Appl. No. 16/214,930, Response filed Apr. 22, 2021 to Non-Final Office Action dated Jan. 26, 2021", 8 pgs.
"U.S. Appl. No. 16/214,930, Final Office Action dated Aug. 2, 2021", 14 pgs.
"U.S. Appl. No. 16/214,930, Response filed Oct. 1, 2021 to Final Office Action dated Aug. 2, 2021", 9 pgs.
"U.S. Appl. No. 16/214,930, Advisory Action dated Oct. 20, 2021", 4 pgs.
"U.S. Appl. No. 16/214,930, Response filed Nov. 2, 2021 to Advisory Action dated Oct. 20, 2021", 9 pgs.
"U.S. Appl. No. 16/214,930, Non Final Office Action dated Dec. 13, 2021", 15 pgs.
"International Application Serial No. PCT/US2020/040336, International Preliminary Report on Patentability dated Jan. 13, 2022", 8 pgs.
"U.S. Appl. No. 16/214,930, Response filed Mar. 14, 2022 to Non Final Office Action dated Dec. 13, 2021", 8 pgs.
"International Application Serial No. PCT/US2021/073083, International Search Report dated Feb. 28, 2022", 6 pgs.
"International Application Serial No. PCT/US2021/073083, Written Opinion dated Feb. 28, 2022", 6 pgs.

* cited by examiner

CONTROLLING THE FLOW OF FLUID TO HIGH PRESSURE PUMPS

TECHNOLOGICAL FIELD

The present disclosure relates to implementations of a system to control the flow of fluid to high pressure pumps. More particularly, the present disclosure relates to a system used in hydraulic fracturing operations to control the flow of proppant-containing fluid to high pressure pumps that supply the fluid to a wellhead.

BACKGROUND

The background description provided herein is for the purpose of generally presenting the context of the disclosure. Work of the presently named inventor(s), to the extent it is described in this background section, as well as aspects of the description that may not otherwise qualify as prior art at the time of filing, are neither expressly nor impliedly admitted as prior art against the present disclosure.

Hydraulic fracturing operations can be used to extract hydrocarbons in the form of petroleum and natural gas from underground geological structures. To extract the hydrocarbons, fluid is pumped at high pressures through a borehole and into the geological structures. As the oil and/or natural gas are released as a result of pumping the fluid into the geological structures, these hydrocarbons are collected. The fluid used to release the hydrocarbons is a mixture of water and at least one proppant. In various examples, the fluid can include additional components, such as chemical additives, that cause the fluid to have characteristics that optimize the extraction of the hydrocarbons.

The proppant used in the hydraulic fracturing fluid can include sand, aluminum oxide, ceramics, and other granular materials. The proppant is mixed with water in a low-pressure environment and distributed to the wellhead via high-pressure pumps using a system of pipes and hoses. The proppant can cause damage to the high-pressure pumps. In situations where flow of the fluid falls below a threshold, the proppant can fall out of solution. When the proppant falls out of solution, damage can occur to the pump. For example, cavitation can take place and can cause inefficient energy use and/or damage to components of the pump.

Existing hydraulic fracturing systems maintain the flow of fluid into the high-pressure pumps above a threshold flow value using manual control of valves that supply the fluid to the high-pressure pumps from the low-pressure fluid supply. In various examples, the responsiveness of modifying the flow rate of fluid to the high-pressure pumps via manual operations can be relatively slow. In situations where unexpected changes to the flow rate of the fluid to the high-pressure pumps takes place, the delays caused by using manual control of the flow rate can lead to the proppant falling out of the fluid, which can result in damage to the high-pressure pumps and inefficiencies in the extraction of hydrocarbons from the well. Additionally, user error with respect to the operation of the low-pressure supply valves can be take place and result in changes to the flow rate of fluid to the high-pressure pumps that can cause the proppant to fall out of solution.

SUMMARY

The following presents a simplified summary of one or more implementations of the present disclosure in order to provide a basic understanding of such implementations. This summary is not an extensive overview of all contemplated implementations, and is intended to neither identify key or critical elements of all implementations, nor delineate the scope of any or all implementations.

In one or more implementations, a hydraulic fracturing system comprises a wellhead and a pump system. The pump system includes one or more high-pressure pumps to deliver fluid to the wellhead and a fluid communication system. The fluid communication system can include a number of valve apparatuses to supply the fluid to the high-pressure pumps. Additionally, the hydraulic fracturing system can include a control system to determine a target flow rate for the fluid supplied to the one or more high-pressure pumps. The control system can also determine a valve apparatus actuation scheme based on the target flow rate. The valve apparatus actuation scheme can indicate that a valve apparatus of the number of valve apparatuses is to be in an open state. Further, the control system can send an actuation signal to the valve apparatus to actuate a flow control member of the valve apparatus.

While multiple implementations are disclosed, still other implementations of the present disclosure will become apparent to those skilled in the art from the following detailed description, which shows and describes illustrative implementations of the invention. As will be realized, the various implementations of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various implementations of the present disclosure, it is believed that the invention will be better understood from the following description taken in conjunction with the accompanying figures. In the figures, the depicted structural elements are not to scale, and certain components may be enlarged relative to the other components for purposes of emphasis and understanding.

DETAILED DESCRIPTION

The present disclosure, in one or more implementations, relates to a system that can control the flow of fluid to high-pressure pumps that are part of a hydraulic fracturing system. More particularly, the system can control the flow of proppant-containing fluid to high pressure pumps such that the proppant is maintained in solution. To illustrate, fluid can be delivered to pumps in a hydraulic fracturing system where the pumps add energy and supply the fluid at high-pressures to the wellhead. The control of the flow rate of the fluid to the high-pressure pumps can take place through the opening and closing of valve apparatuses in an automated manner using a control system. The valve apparatuses can include a valve control device that receives signals from the control system. The valve control device can include an actuating mechanism that is coupled to a flow control member. Based on signals received by the valve control device from a control system, the actuating mechanism of the valve apparatus can cause the flow control member of the valve apparatus to open or close. The number of valve apparatuses in the system that are open or closed at a given time can be based on achieving at least a threshold flow rate of the fluid such that proppant included in the fluid does not fall out of solution.

Figure 1:
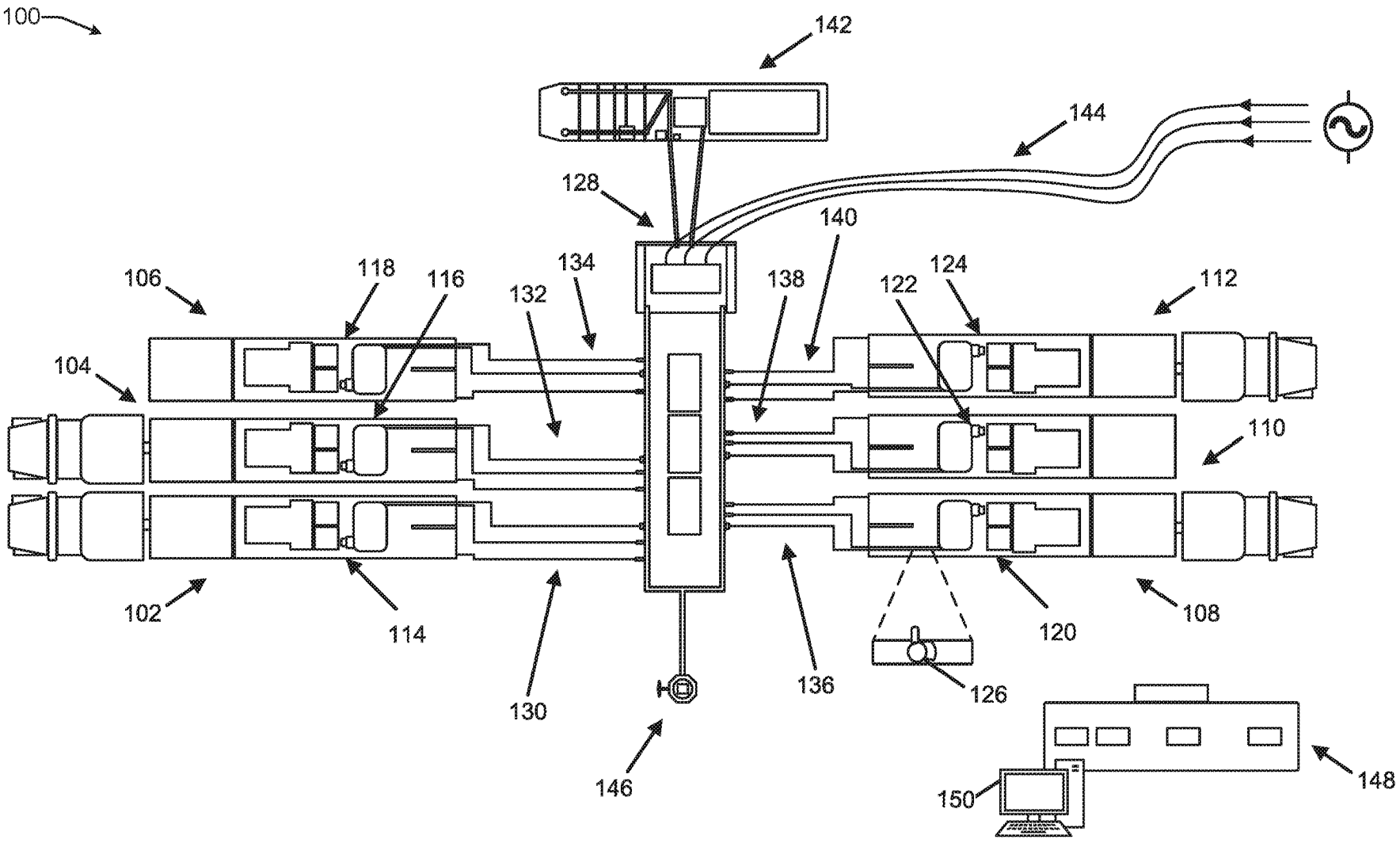
FIG. 1 is a top view of an environment that includes a hydraulic fracturing system that includes components to control the flow of fluid to high-pressure pumps, according to one or more implementations.

FIG. 1 is a top view of an environment that includes a hydraulic fracturing system 100 that includes components to control the flow of fluid to high-pressure pumps, according to one or more implementations. The hydraulic fracturing system 100 can include a number of high-pressure pumps that are mounted to trailers. In various examples, the trailers can be coupled to a truck. The illustrative example of FIG. 1 includes a first trailer 102, a second trailer 104, a third trailer 106, a fourth trailer 108, a fifth trailer 110, and a sixth trailer 112. Individual trailers 102, 104, 106, 108, 110, 112 can carry a pumping system. Each pumping system can include one or more high-pressure pumps, one or more pump engines, transmission components, a heating system, a cooling system, an exhaust system, monitoring devices, control devices, a fluid communication system, one or more combinations thereof, and the like.

The first trailer 102 can carry a first pumping system 114, the second trailer 104 can carry a second pumping system 116, the third trailer 106 can carry a third pumping system 118, the fourth trailer 108 can carry a fourth pumping system 120, the fifth trailer 110 can carry a fifth pumping system 122, and the sixth trailer 112 can carry a sixth pumping system 124. In various example, fluid communication systems of the pump systems 114, 116, 118, 120, 122, 124 can include a number of pipes, a number of hoses, or a combination thereof. In one or more examples, the fluid communication systems of the pump systems 114, 116, 118, 120, 122, 124 can include valve apparatuses, such as an illustrative valve apparatus 126. The valve apparatuses 126 can control the supply of fluid to high-pressure pumps of the pump systems 114, 116, 118, 120, 122, 124.

The pump systems 114, 116, 118, 120, 122, 124 mounted on the trailers 102, 104, 106, 108, 110, 112 are coupled to a fluid and power delivery system 128. The fluid and power delivery system 128 can include a number of inlet ports and a number of outlet ports that are coupled to fluid transmission lines. The fluid and power delivery system 128 can also include a number of power transmission ports that are coupled to power transmission lines. For example, the fluid delivery system 128 can be coupled to the first pump system 114 by a first set of fluid and power transmission lines 130 and to the second pump system 116 by a second set of fluid and power transmission lines 132. In addition, the fluid and power delivery system 128 can be coupled to the third pump system 118 by a third set of fluid and power transmission lines 134 and to the fourth pump system 120 by a fourth set of fluid and power transmission lines 136. Further, the fluid and power delivery system 128 can be coupled to the fifth pump system 122 by a fifth set of fluid and power transmission lines 138 and to the sixth pump system 124 by a sixth set of fluid and power transmission lines 140. The fluid power and delivery system 128 can also be coupled to a fluid source 142 and to a power source 144. In one or more examples, the fluid source 142 can include a blender that mixes water and one or more proppants to produce a fluid that can be supplied to high-pressure pumps of the pump systems 114, 116, 118, 120, 122, 124. In one or more additional examples, the fluid source 142 can include one or more tanks. The hydraulic fracturing system 100 can also include a wellhead 146 that is coupled to the fluid and power delivery system 128. Hydrocarbons can be extracted from the wellhead 146 during hydraulic fracturing operations performed by the hydraulic fracturing system 100.

The fluid supplied by the fluid source 142 to the fluid and power delivery system 128 can include a mixture of water with one or more proppants. The one or more proppants can include at least one of a silica-containing material, such as sand, a ceramic proppant, or a resin coated proppant. The proppant can have a diameter from at least about 100 micrometers to no greater than about 2.5 millimeters.

Additionally, the hydraulic fracturing system 100 can include a control center 148. The control center 148 can include a control system 150. The control system 150 can include one or more computing devices that include memory and one or more processing units. The control system 150 can be coupled to a number of sensor devices of the pump systems 114, 116, 118, 120, 122, 124 and to a number of sensor devices of the fluid and power delivery system 128. In one or more examples, the control system 150 can be coupled to monitoring devices of the pump systems 114, 116, 118, 120, 122, 124. The control system 150 can also be coupled to control devices of the pump systems 114, 116, 118, 120, 122, 124. The control devices can control the operation of components of the pump systems 114, 116, 118, 120, 122, 124. In one or more examples, the control devices can include actuators, such as actuators of the valve apparatuses 126.

The control system 150 can send signals to control devices of the pump systems 114, 116, 118, 120, 122, 124 to control flow of fluid from a low pressure fluid source 142 to high pressure pumps included in the pumping systems 114, 116, 118, 120, 122, 124. In one or more examples, the fluid obtained from the fluid source 142 can be delivered to the pump systems 114, 116, 118, 120, 122, 124 at pressures of at least about 70 pounds per square inch (psi), at least about 80 psi, at least about 90 psi, at least about 100 psi, at least about 120 psi, at least about 135 psi, or at least about 150 psi. Additionally, the fluid obtained from the fluid source 142 can be delivered to the pump systems 114, 116, 118, 120, 122, 124 at pressures of no greater than about 300 psi, no greater than about 275 psi, no greater than about 250 psi, no greater than about 225 psi, no greater than about 200 psi, or no greater than about 175 psi. In one or more illustrative examples, the fluid obtained from the fluid source 142 can be delivered to pump systems 114, 116, 118, 120, 122, 124 at pressures from about 70 psi to about 300 psi, from about 80 psi to about 200 psi, from about 90 psi to about 150 psi, or from about 100 psi to about 120 psi. Fluid at still other pressures may be delivered to the pump systems 114, 116, 118, 120, 122, 124.

In one or more examples, the control system 150 can determine a target flow rate for fluid from the fluid and power delivery system 128 through the fluid communication systems of the pump systems 114, 116, 118, 120, 122, 124.

In various examples, the flow rate can be based on a stage of the hydraulic fracturing process that is being performed by the hydraulic fracturing system 100. For example, the control system 150 can determine a target flow rate for the flow of fluid from the fluid and power delivery system 128 through the fluid communication systems of the pump systems 114, 116, 118, 120, 122, 124 during a pad stage of the hydraulic fracturing process where fluid is delivered to the wellhead 146 to break a formation under the hydraulic fracturing system 100 and initiate fracturing of the formation. Additionally, the control system 150 can determine an additional target flow rate for the flow of fluid from the fluid and power delivery system 128 through the fluid communication systems of the pump systems 114, 116, 118, 120, 122, 124 during a proppant stage of the hydraulic fracturing process where fluid including proppant is delivered to the wellhead 146 and into the formation under the hydraulic fracturing system 100. Further, the control system 150 can determine a further target flow rate for the flow of fluid from the fluid and power delivery system 128 through the fluid communication systems of the pump systems 114, 116, 118, 120, 122, 124 during a flush stage of the hydraulic fracturing process where water is delivered to the wellhead 146 to flush excess proppant that may be present in the wellbore.

In one or more examples, the target flow rate during the proppant stage can correspond to a flow rate that enables the proppant to stay in solution. In various examples, a target flow rate during the proppant stage can comprise a range of flow rates. In one or more illustrative examples, the target flow rate during the proppant stage can be at least about 25 barrels per minute (bpm), at least about 30 bpm, at least about 35 bpm, at least about 40 bpm, at least about 45 bpm, or at least about 50 bpm. In one or more additional examples, the target flow rate during the proppant stage can be no greater than about 200 bpm, no greater than about 150 bpm, no greater than about 125 bpm, no greater than about 100 bpm, or no greater than about 75 bpm. In one or more illustrative examples, the target flow rate during the proppant stage can be from about 25 bpm to about 200 bpm, from about 40 bpm to about 150 bpm, or from about 50 bpm to about 125 bpm. The target flow rate can also include still other flow rates.

After determining the target flow rate, the control system can determine a number of valve apparatuses 126 to open and a number of valve apparatuses 126 to close to achieve the target flow rate. In various examples, at least a portion of the valve apparatuses 126 are configured to be partially open. In these scenarios, the control system 150 can determine an amount by which one or more of the valve apparatuses 126 are to be opened. In one or more examples, the valve apparatuses 126 can be configured in a state that is opened, closed, or partially opened according to one or more gradations. For example, a valve apparatus 126 can be at least about 5% open, at least about 10% open at least about 20% open, at least about 30% open, at least about 40% open, at least about 50% open, at least about 60% open, at least about 70% open, at least about 80% open, or at least about 90% c open.

The control system 150 can also determine locations of a specified number of valve apparatuses 126 within the pump systems 114, 116, 118, 120, 122, 124 and an extent to which the specified number of valve apparatuses 126 are to be open. To illustrate, the control system 150 can determine a number of valve apparatuses 126 of the first pump system 114 to open and/or close, a number of valve apparatuses 126 of the second pump system 116 to open and/or close, a number of valve apparatuses 126 of the third pump system 118 to open and/or close, a number of valve apparatuses 126 of the fourth pump system 120 to open and/or close, a number of valve apparatuses 126 of the fifth pump system 122 to open or close, a number of valve apparatuses 126 of the sixth pump system 122 to open or close, or one or more combinations thereof. In various examples, a different number of valve apparatuses 126 for at least one of the pump systems 114, 116, 118, 120, 122, 124 can be opened and/or closed with respect to a number of valve apparatuses 126 of at least one other of the pump systems 114, 116, 118, 120, 122, 124. In one or more examples, the control system 150 can also determine an amount by which to open respective valve apparatuses of individual pump systems 114, 116, 118, 120, 122, 124. The number of valve apparatuses 126 to be opened, the locations of the valve apparatuses to be opened, and, in some implementations, the amount the valve apparatuses 126 are to be opened can correspond to a valve apparatus actuation scheme. After determining the valve apparatus actuation scheme, the control system 150 can send control signals to signal receiving units of the valve apparatuses 126 according to the valve apparatus actuation scheme.

In one or more scenarios, the control system 150 can monitor conditions within the pump systems 114, 116, 118, 120, 122, 124 based on data obtained from sensor devices of the pump systems 114, 116, 118, 120, 122, 124 and the fluid and power transmission system 128. The control system 150 can determine whether the flow rate for fluid delivered to pumps of the pump systems 114, 116, 118, 120, 122, 124 is outside of a threshold range of a target flow rate. In situations where the flow rate for fluid delivered to pumps of the pump systems 114, 116, 118, 120, 122, 124 moves outside of the threshold range of the target flow rate, the control system 150 can determine one or more operations to move the flow rate back to within the threshold range of the target flow rate. For example, in scenarios where the actual flow rate is less than a minimum flow rate for fluid delivered to pumps of the pump systems 114, 116, 118, 120, 122, 124, the control system 150 can determine a modified valve apparatus actuation scheme. Based on the modified valve apparatus actuation scheme, the control system 150 can send signals to one or more valve apparatuses 126 to close fully or partially to cause the flow rate to increase above the minimum flow rate. In addition, in scenarios where the actual flow rate is greater than a maximum flow rate for fluid delivered to pumps of the pump systems 114, 116, 118, 120, 122, 124, the control system 150 can determine an additional modified valve apparatus actuation scheme. According to the additional modified valve apparatus actuation scheme, the control system 150 can send signals to one or more valve apparatuses 126 to open fully or partially to cause the flow rate to decrease below the maximum flow rate. In various examples, the minimum flow rate and the maximum flow rate of fluid delivered to pumps of the pump systems 114, 116, 118, 120, 122, 124; can be set based on stage of operation can be based on a stage of the hydraulic fracturing process that is being implemented by the hydraulic fracturing system 100.

In various implementations, the control system 150 can generate one or more user interfaces. The one or more user interfaces can capture input from an operator that corresponds to information used to generate a valve apparatus actuation scheme, such as a location of a valve apparatus that is to be opened or closed and/or an amount that a valve apparatus is to be opened or closed. The one or more user interfaces can also indicate at least one of past, current, or future conditions of components of the hydraulic fracturing system 100. For example, the control system 150 can generate one or more user interfaces that indicate flow rate of fluid supplied to high-pressure pumps of the pump systems 114, 116, 118, 120, 122, 124. In addition, the control system 150 can generate one or more user interfaces indicating alerts in response to the flow rate of fluid supplied to the high-pressure pumps being outside of a threshold range of flow rates.

Figure 2:
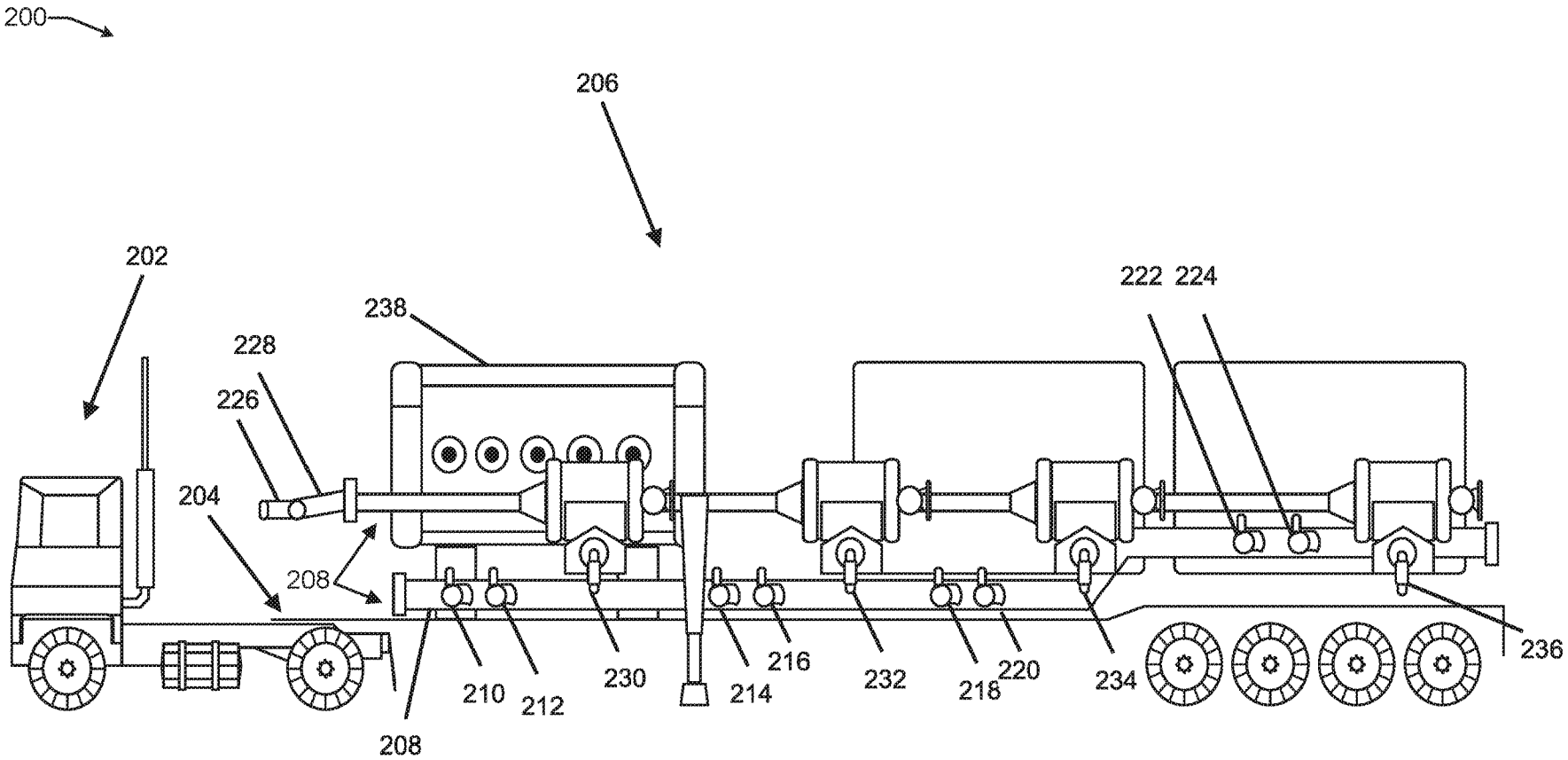
FIG. 2 is a side view of a system that includes at least one high-pressure pump to supply fluid to a wellhead and a number of valve apparatuses to control the supply of fluid to the number of high-pressure pumps, according to one or more implementations.

FIG. 2 is a side view of a system 200 that includes at least one high-pressure pump to supply fluid to a wellhead and a number of valve apparatuses to control the supply of fluid to the number of high-pressure pumps, according to one or more implementations. The system 200 can include a truck 202 and a trailer 204. The trailer 204 can include a pump system 206 that can deliver fluid to a wellhead in a hydraulic fracturing system. The pump system 206 can include a fluid communication system 208. The fluid communication system 208 can include a series of pipes and/or hoses that carry fluid throughout the pump system 206. The fluid communication system 208 can also include a number of inlet ports that supply fluid into the pump system 206. For example, the fluid communication system 208 can include a first inlet port 210, a second inlet port 212, a third inlet port 214, a fourth inlet port 216, a fifth inlet port 218, a sixth inlet port 220, a seventh inlet port 222, and an eighth inlet port 224. Fluid can be received at one or more of the inlet ports 210, 212, 214, 216, 218, 220, 222, 224 from a fluid supply. In one or more illustrative examples, the fluid can be received at one or more of the inlet ports 210, 212, 214, 216, 218, 220, 222, 224 from a fluid and power delivery system, such as the fluid and power delivery system 128 of FIG. 1. The inlet ports 210, 212, 214, 216, 218, 220, 222, 224 can comprise respective valve apparatuses that can open and close in an automated manner in response to signals obtained from a control system. In this way, the inlet ports 210, 212, 214, 216, 218, 220, 222, 224 can be actuated to control the flow rate of fluid into the pump system 206.

Additionally, the fluid communication system 208 can include a number of outlet ports that carry fluid out of the pump system 206. To illustrate, the fluid communication system 208 can include a first outlet port 226, a second outlet port 228, a third outlet port 230, a fourth outlet port 232, a fifth outlet port 234, and a sixth outlet port 236. In various examples, one or more outlet ports 226, 228, 230, 232, 234, 236 can deliver fluid to a wellhead. In one or more illustrative examples, the outlet ports 226, 228, 230, 232, 234, 236 can deliver fluid to the wellhead via a fluid power and transmission delivery system, such as the fluid and power delivery system 128 of FIG. 1.

Although the example pump system 206 shown in FIG. 2 shows that the fluid communication system 208 has an illustrative arrangement that includes a specified number of inlet ports and outlet ports, in additional examples, the fluid communication system 208 can have a different number of inlet ports and/or a different number of outlet ports, such as fewer inlet ports, fewer outlet ports, a greater number of inlet ports, a greater number of outlet ports, or one or more combinations thereof.

The pump system 206 can also include a high-pressure pump 238. The high-pressure pump 238 can receive fluid via one or more of the inlet ports 210, 212, 214, 216, 218, 220, 222, 224 of the fluid communication system 208. In addition, the high-pressure pump 238 can deliver fluid via one or more of the outlet ports 226, 228, 230, 232, 234, 236. The high-pressure pump 238 can be a reciprocating positive displacement pump. In one or more examples, the high-pressure pump 238 can be a multi-stage centrifugal pump.

The high-pressure pump 238 can have a horsepower capacity of at least about 1000 brake horsepower (bhp), at least about 1250 bhp, at least about 1500 bhp, at least about 1750 bhp, at least about 2000 bhp, at least about 2250 bhp, at least about 2500 bhp, at least about 2750 bhp, or at least about 3000 bhp. In addition, the high-pressure bump 238 can have a horsepower capacity of no greater than about 6000 bhp, no greater than about 5500 bhp, no greater than about 5000 bhp, no greater than about 4500 bhp, no greater than about 4000 bhp, or no greater than about 3500 bhp. In one or more illustrative examples, the high-pressure pump 238 can have a horsepower capacity from about 1000 bhp to about 6000 bhp, from about 1500 bhp to about 5000 bhp, or from about 2000 bhp to about 3000 bhp. The high-pressure pump 238 can have still other horsepower capacities.

Further, the high-pressure pump 238 can deliver fluid at pressures of at least about 7500 psi, at least about 8000 psi, at least about 9000 psi, at least about 10,000 psi, at least about 11,000 psi, at least about 12,000 psi, at least about 13,000 psi, at least about 14,000 psi, or at least about 15,000 psi. In various examples, the high-pressure pump 238 can deliver fluid at pressures of no greater than about 25,000 psi, no greater than about 24,000 psi, no greater than about 23,000 psi, no greater than about 22,000 psi, no greater than about 21,000 psi, no greater than about 20,000 psi, no greater than about 19,000 psi, no greater than about 18,000 psi, no greater than about 17,000 psi, or no greater than about 16,000 psi. In one or more illustrative examples, the high-pressure pump 238 can deliver the fluid at pressures from about 7500 psi to about 25,000 psi, from about 10,000 psi to about 20,000 psi, and from about 12,000 psi to about 18,000 psi. The high-pressure pump 238 can deliver fluid at still other pressures.

Although the illustrative example of FIG. 2 shows a single high-pressure pump 238 mounted on the trailer 204, the pump system 206 can include a number of high-pressure pumps, such as two high-pressure pumps, three high-pressure pumps, or four or more high-pressure pumps. Additionally, the pump system 206 can include a number of additional components mounted to or otherwise located on the trailer 204 that are not shown in FIG. 2. For example, the pump system 206 can include a pump engine that can supply energy to the high-pressure pump 236 and a transmission to drive the high-pressure pump 236. In one or more additional examples, the pump system 206 can include a heating system, a cooling system, an exhaust system, or one or more combinations thereof. In one or more further examples, the pump system 206 can include a number of sensor devices, such as flow rate sensors, pressure sensors, temperature sensors, and the like. The sensor devices can send data to a control system, such as the control system 150 of FIG. 1. In various examples, the pump system 206 can include a number of control components to manually control the operation of one or more elements of the pump system 206 and/or a number of additional control components to automatically control the operation of one or more elements of the pump system 206.

Figure 3B:
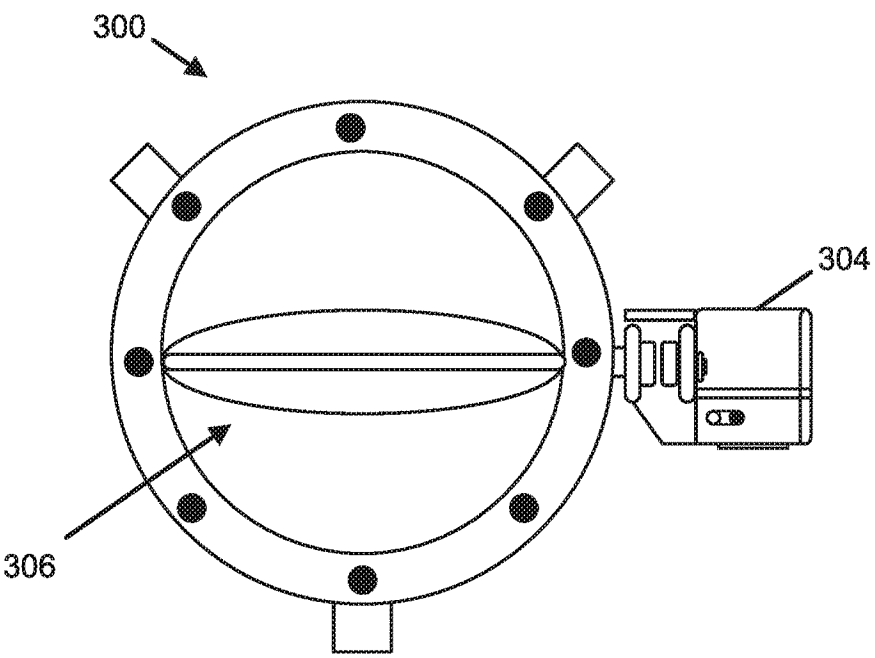
FIG. 3B is a front view of a valve apparatus without the front cover member, according to one or more implementations.
Figure 3A:
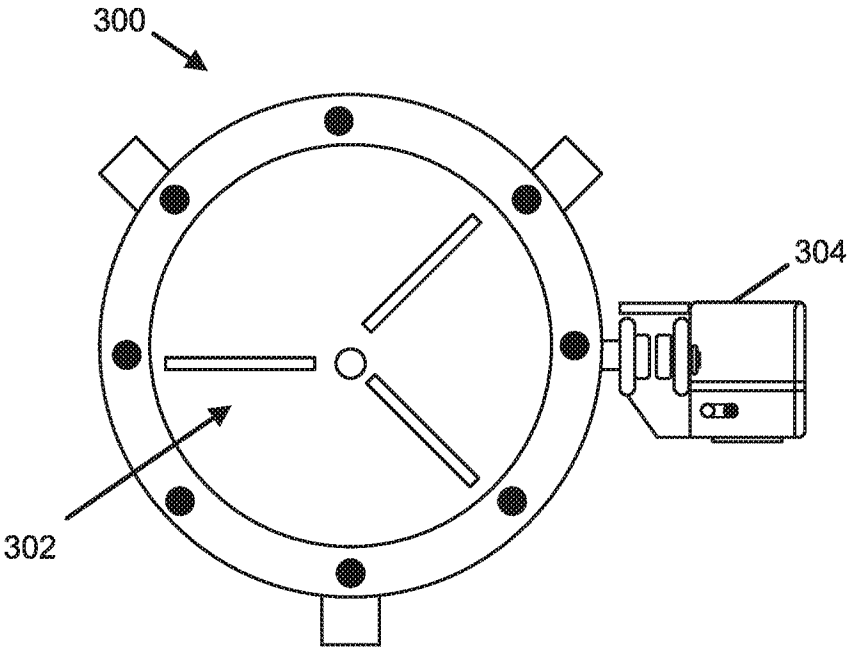
FIG. 3A is a front view of a valve apparatus with a front cover member.

FIG. 3A is a front view of a valve apparatus 300 with a front cover member 302. FIG. 3B is a front view of a valve apparatus 300 without the front cover member 302. The valve apparatus 304 can include a valve control device 304. The valve control device 304 can be coupled to a flow control member 306. The valve control device 304 can control an amount that the flow control member 306 is open or an amount that the flow control member 306 is closed. In one or more examples, the valve control device 304 can be coupled to an actuator that is configured to move the flow control member 306. In this way, the valve control device 304 can regulate a flow rate of fluid that is moving through the valve control apparatus 300.

Additionally, the valve control device 304 can include electronic components to accept signals from a control system, such as the control system 150 of FIG. 1, and to move the flow control member 306 according to the signals. In one or more illustrative examples, the valve control device 304 can include a signal receiving unit to receive signals from a control system via a wired transmission line. In one or more additional illustrative examples, the valve control device 304 can include a signal receiving unit to receive wireless signals from a control system. In one or more additional examples, the valve control device 304 can include a signal transmitting unit to transmit wired signals or wireless signals to a control system.

In one or more examples, the flow control member 306 can be set at a number of positions. For example, the flow control member 306 can be fully open or fully closed. In one or more additional examples, the flow control member 306 can be partially open or partially closed. That is, the flow control member can be opened or closed according to a number of gradations.

One or more components of the valve apparatus 300 can be comprised of a metallic material, such as steel. In one or more examples, one or more components of the valve apparatus 300 can be comprised of a polymeric material. In various examples, the valve apparatus 300 can have an inner diameter of at least about 3 inches, at least about 3.5 inches, at least about 4 inches, at least about 4.5 inches, or at least about 5 inches. Further, the valve apparatus 300 can have an inner diameter no greater than about 8 inches, no greater than about 7.5 inches, no greater than about 7 inches, no greater than about 6.5 inches, or no greater than about 6 inches. In one or more illustrative examples, the valve apparatus 300 can have an inner diameter from about 3 inches to about 8 inches or from about 3.5 inches to about 6 inches.

Although the illustrative example of FIG. 3B shows that the valve apparatus 300 is configured as a butterfly valve, the valve apparatus 300 can also be configured as other types of valves. To illustrate, the valve apparatus 300 can be configured as another type of flow control valve, such as a ball valve or a choke valve. Additionally, although not shown in the illustrative examples of FIG. 3A and FIG. 3B, the valve apparatus 300 can additionally include a manual valve control device to control the flow of fluid through the valve apparatus 300, such as a wheel or knob that changes the position of the flow control member 306. Further, although not shown in the illustrative examples of FIG. 3A and FIG. 3B, the valve apparatus 300 can include one or more sensor devices. The one or more sensor devices can be used to monitor conditions with respect to fluid flowing through the valve apparatus 300, such as flow rate, temperature, and/or pressure. In various examples, the signals generated by the one or more sensor devices can be transmitted to a control system via a wired communication interface or a wireless communication interface.

Figure 4:
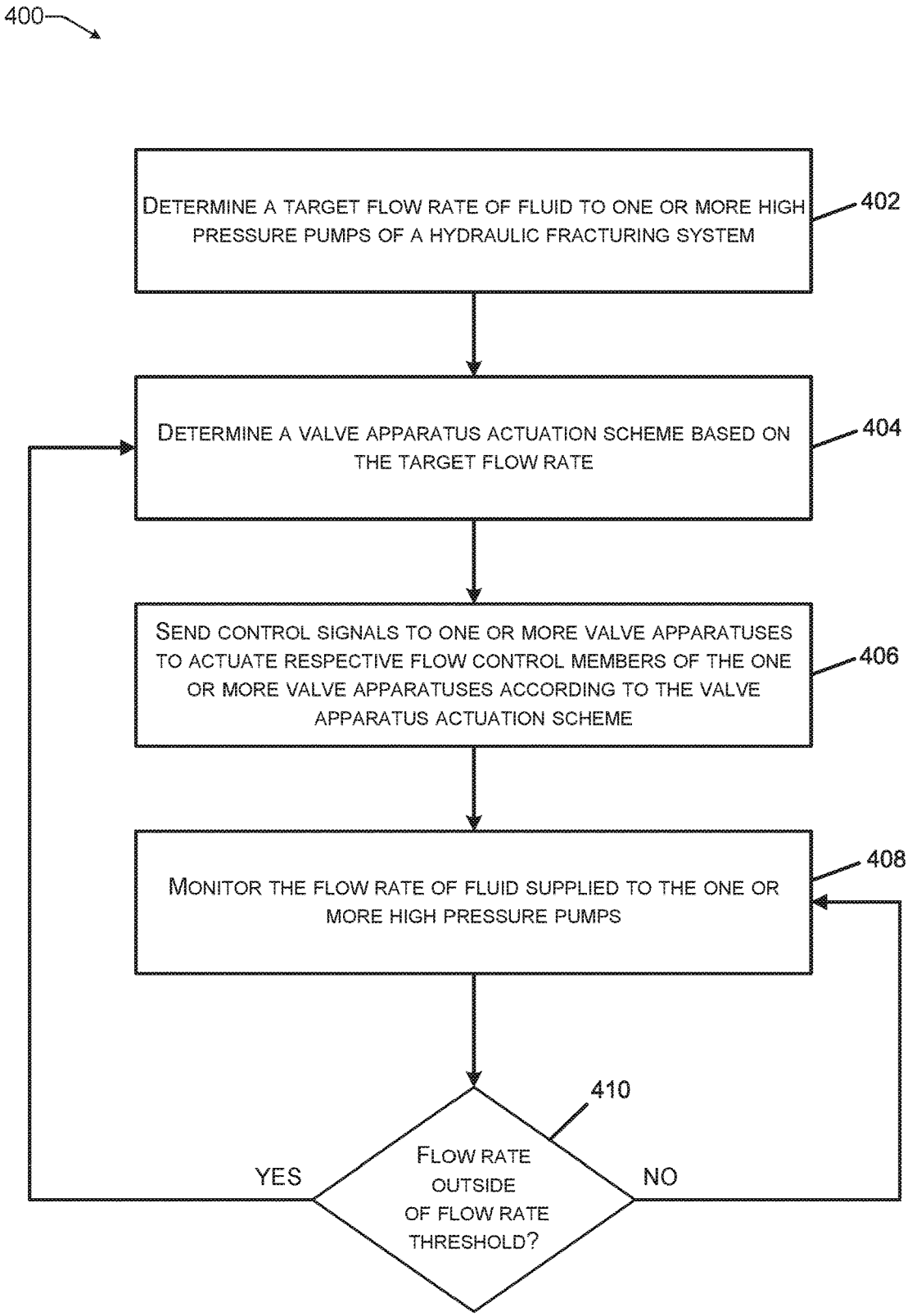
FIG. 4 is a flow diagram of a method to control the flow of fluid to high-pressure pumps that are part of a hydraulic fracturing system, according to one or more implementations.

FIG. 4 is a flow diagram of a method 400 to control the flow of fluid to high-pressure pumps that are part of a hydraulic fracturing system, according to one or more implementations. Implementations described herein can control the flow rate of fluid provided to high-pressure pumps in order to maintain a threshold flow rate of the fluid and minimize the amount of time that the flow rate of the fluid falls below the threshold flow rate. By causing the flow rate of the fluid to be at least the threshold flow rate, proppant included in the fluid can stay in solution. Thus, the implementations described herein can minimize the damage that occurs to high-pressure pumps in existing hydraulic fracturing systems when the proppant falls out of solution due to the flow rate of the fluid supplied to the high-pressure pumps falling below a threshold flow rate. Additionally, minimizing the amount of time that the flow rate of the fluid supplied to the high-pressure pumps is below the threshold flow rate, can minimize the amount of time that one or more high-pressure pumps of the hydraulic fracturing system may be taken offline due to a pump, hose, or pipe being clogged by proppant that has fallen out of solution.

In addition, the implementations described herein can control the flow rate of fluid provided to high-pressure pumps in order to maintain a threshold flow rate of a hydraulic fracturing system in an automated manner. For example, valve apparatuses that supply fluid to high-pressure pumps of the hydraulic fracturing system can be in communication with a control system via a wired communication system or a wireless communication system. In this way, the implementations described herein are different from existing systems and techniques that rely on operators to manually actuate the valves that supply fluid to the high-pressure pumps. In this way, operator error in setting the flow rate of fluid to the high-pressure pumps can be minimized. Thus, by maintaining at least a threshold flow rate of fluid supplied to the high-pressure pumps, operation of the pumps can be optimized. Additionally, by reducing the need for operators in areas of a hydraulic fracturing system around the high-pressure pumps, operator safety can be increased.

Further, automating the control and monitoring of the flow rate of fluid supplied to the high-pressure pumps of a hydraulic fracturing system can minimize the time between detecting that the flow rate of fluid falls below the threshold flow rate and the time that the valve apparatuses are actuated to correct the flow rate. As a result, damage to the high-pressure pumps is minimized in relation to existing systems. Also, the automated control and monitoring of the flow rate of fluid supplied to the high-pressure pumps of a hydraulic fracturing system can optimize the flow rate of the fluid, which can lead optimizing the suction pressure to the high-pressure pumps (i.e., the boost pressure) leading to increased pump life and reduced downtime for service.

The method 400 may include, at 402, determining a target flow rate of fluid to one or more high-pressure pumps of a hydraulic fracturing system. In various examples, the target flow rate can be determined by a control system, such as the control system 150 of FIG. 1. In one or more scenarios, the target flow rate can be determined by the control system based on input received from an operator of the control system. In various examples, the target flow rate can be based on a demand of the one or more high-pressure pumps. In one or more examples, the demand on the one or more high-pressure pumps can be based on a stage of the hydraulic fracturing process that is being performed by the hydraulic fracturing system. Different target flow rates can be determined for different stages of the hydraulic fracturing process. To illustrate, a first target flow rate can be determined for a pad stage of the hydraulic fracturing process, a second target flow rate can be determined for a proppant stage of the hydraulic fracturing process, and a third target flow rate can be determined for a flush stage of the hydraulic fracturing process. In one or more illustrative examples, the target flow rate can be from about 30 bpm to about 100 bpm.

The target flow rate can be determined based on characteristics of the fluid being delivered to the high-pressure pumps. For example, the fluid can include a proppant that is carried in a carrier fluid. In one or more examples, the proppant can include sand or another silica-containing material and the carrier fluid can include water. The fluid can also include one or more chemical additives. In various examples, the target flow rate can be based on a density of the carrier fluid and a mass and/or size of the proppant. The target flow rate can also be based on a temperature of the fluid. In one or more illustrative examples, the target flow rate can be set such that the proppant remains in solution as the fluid moves through one or more pump systems that include the high-pressure pumps.

In one or more scenarios, the target flow rate can be within a range of a minimum threshold flow rate, where the minimum threshold flow rate corresponds to a flow rate at which the proppant included in the fluid falls out of solution. To illustrate, the target flow rate can be at least about 10% greater than a minimum threshold flow rate, at least about 20% greater than the minimum threshold flow rate, at least about 30% greater than the minimum threshold flow rate, at least about 40% greater than the minimum threshold flow rate, or at least about 50% greater than a minimum threshold flow rate. In one or more examples, the target flow rate can be less than a maximum threshold flow rate. For example, the target flow rate can be at least 10,% less than a maximum threshold flow rate, at least about 20% less that the maximum threshold flow rate, at least about 30% less than the maximum threshold flow rate, at least about 40% less than the maximum threshold flow rate, or at least about 50% less than the maximum threshold flow rate.

The process 400 can also include, at 404, determining a valve apparatus actuation scheme based on the target flow rate. In one or more illustrative examples, the valve apparatus actuation scheme can be determined by a control system, such as the control system 150 of FIG. 1. The valve apparatus actuation scheme can indicate a number of valve apparatuses of the hydraulic fracturing system that are to be opened and a number of valve apparatuses of the hydraulic fracturing system that are to be closed. For example, in a pump system having eight valve apparatuses, the valve apparatus actuation scheme can indicate that six valve apparatuses are to be opened and that two valve apparatuses are to be closed. In one or more examples, the valve apparatus actuation scheme can indicate a number of valve apparatuses to be opened or closed for individual pump systems within the hydraulic fracturing system. In various examples, at least one pump system of the hydraulic fracturing system can have a different number of valves opened and closed with respect to another pump system of the hydraulic fracturing system. In addition, the valve apparatus actuation scheme can indicate locations of valve apparatuses that are to be opened or closed. To illustrate, the valve apparatus actuation scheme can that a respective valve apparatus of a pump system of a hydraulic fracturing system is to be opened or closed.

In implementations where the valve apparatuses can be opened according to a number of gradations, the valve apparatus actuation scheme can indicate an amount that one or more valve apparatuses are to be opened or closed. For example, the valve apparatus actuation scheme can indicate one or more valve apparatuses that are to be opened 50%. In one or more examples, the valve apparatus actuation scheme can indicate one or more valve apparatuses that are to be partially opened in addition to a number of valve apparatuses that are to be fully opened and a number of valve apparatuses that are to be fully closed.

At 406, the method 400 can include sending signals from a control system to one or more valve apparatuses of the hydraulic fracturing system to actuate respective flow control members of the one or more valve apparatuses according to the valve apparatus actuation scheme. The signals can be transmitted using a wired communication system that includes data transmission lines coupled between the control system and the one or more valve apparatuses. In one or more additional examples, the signals can be transmitted using a wireless communication system from a transmitter unit of the control system to a receiver unit of the one or more valve apparatuses. In various examples, at least a portion of the control signals can be sent without input from an operator of the control system. In one or more additional examples, at least a portion of the control signals can be sent in response to input obtained by the control system from an operator of the control system. The control signals can include electronic signals and/or digital signals.

In addition, at 408, the method 400 can include monitoring the flow rate of fluid to the one or more high pressure pumps. The flow rate can be monitored in real time or near real time based on data obtained from a number of sensor devices of the hydraulic fracturing system. The sensor devices can be located in valve apparatuses of the hydraulic fracturing system, in fluid communication systems of the hydraulic fracturing system, in high-pressure pumps of the hydraulic fracturing system, or one or more combinations thereof. The data obtained from the sensor devices can be used by a control system to determine a respective current flow rate of fluid through the one or more high-pressure pumps.

Further, the method 400 can include, at 410, determining whether the flow rate is outside of a flow rate threshold. For example, the current flow rate can be analyzed with respect to a minimum threshold flow rate. In one or more examples, the current flow rate can be analyzed with respect to a maximum threshold flow rate. In various examples, the current flow rate can be determined to be within the flow rate threshold when the current flow rate is within a specified amount of a minimum flow rate or within a specified amount of a maximum flow rate, such as within 5%, within 10%, or within 15% of the minimum flow rate or the maximum flow rate.

In situations where the current flow rate is not within a flow rate threshold, the method 400 can return to 408, where the flow rate of fluid supplied to the one or more high pressure pumps continues to be monitored. In scenarios where the current flow rate is outside of a flow rate threshold, the method 400 can proceed to 404, where a modified valve apparatus actuation scheme is determined. In one or more illustrative examples, an alert can be generated when the current flow rate is outside of the flow rate threshold. The modified valve apparatus actuation scheme can be determined based on a difference between the current flow rate and the target flow rate. In one or more scenarios, the valve apparatus actuation scheme can indicate the opening and/or closing of one or more valve apparatuses of the hydraulic fracturing system to move the flow rate of fluid supplied to the one or more high-pressure pumps back to a flow rate that is greater than a minimum threshold flow rate or less than a maximum threshold flow rate. In one or more examples, the modified valve apparatus actuation scheme can indicate an amount in which one or more valve apparatuses are to be opened or closed. In various examples, the modified valve apparatus actuation scheme can be determined, at least in part, based on input from an operator of the control system.

In one or more illustrative examples, the modified valve apparatus actuation scheme can indicate a change of state of a valve apparatus from a current state to a modified state. For example, an initial valve apparatus actuation scheme can indicate that a valve apparatus is in an open state and the modified valve apparatus actuation scheme can indicate that the valve apparatus is to be changed to a closed state. In one or more additional examples, an initial valve apparatus actuation scheme can indicate that a valve apparatus is in a closed state and the modified valve apparatus actuation scheme can indicate that the valve apparatus is to be changed to an open state. Further, in scenarios where a valve apparatus can be opened or closed according to a number of gradations, an initial valve apparatus actuation scheme can indicate that a valve apparatus is in a state that is 50% open and the modified valve apparatus actuation scheme can indicate that the valve apparatus is to be changed to a 75% open state.

Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various implementations of the present disclosure. In addition, the order of the method steps or process operations illustrated in a flowchart or block diagram may be rearranged for some implementations. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, implementation, or composition that is "substantially free of" or "generally free of" an element may still actually contain such element as long as there is generally no significant effect thereof.

In the foregoing description various implementations of the present disclosure have been presented for the purpose of illustration and description. They are not intended to be exhaustive or to limit the invention to the precise form disclosed. Obvious modifications or variations are possible in light of the above teachings. The various implementations were chosen and described to provide the best illustration of the principals of the disclosure and their practical application, and to enable one of ordinary skill in the art to utilize the various implementations with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A hydraulic fracturing system comprising:

a well head;

a pump system that includes:

one or more high-pressure pumps to deliver fluid to the wellhead, the fluid including proppant; and a number of valve apparatuses to supply the fluid to the one or more high-pressure pumps;

a control system to:

determine a target flow rate sufficient to maintain the proppant in solution within the one or more high-pressure pumps;

determine a valve apparatus actuation scheme based on the target flow rate, the valve apparatus actuation scheme indicating a state for individual valve apparatuses of the number of valve apparatuses of the pump system to achieve a minimum flow rate of the fluid through the one or more high-pressure pumps to maintain the proppant in solution within the one or more high-pressure pumps; and send an actuation signal to one or more valve apparatuses of the number of valve apparatuses of the pump system to actuate individual flow control members of the one or more valve apparatuses of the pump system; and a fluid and power delivery system coupled between the pump system and a fluid source, the fluid and power delivery system to deliver the fluid to the pump system from the fluid source.

2. The hydraulic fracturing system of claim 1, wherein the individual valve apparatuses includes a signal receiving unit and an actuator, the actuator being configured to move a flow control member of the individual valve apparatuses.

3. The hydraulic fracturing system of claim 2, wherein the signal receiving unit is coupled to one or more wires that communicate signals between the signal receiving unit and the control system.

4. The hydraulic fracturing system of claim 2, wherein the signal receiving unit includes a transceiver to wirelessly communicate signals between the signal receiving unit and the control system.

5. The hydraulic fracturing system of claim 1, wherein the pump system is located on a trailer that is coupled to the fluid and power delivery system by one or more fluid and power transmission lines.

6. The hydraulic fracturing system of claim 1, wherein the fluid is delivered to the pump system at pressures from about 90 pounds per square inch (psi) to about 150 psi and the one or more high-pressure pumps deliver the fluid to the wellhead at pressures from about 10,000 psi to about 20,000 psi.

7. The hydraulic fracturing system of claim 1, wherein the target flow rate is from about 50 barrels per minute (bpm) to about 125 bpm.

8. The hydraulic fracturing system of claim 1, wherein the individual flow control members of the individual valve apparatuses are configured to open according to a plurality of gradations, an inner diameter of the valve apparatus is from about 3.5 inches to about 6 inches, and the individual valve apparatuses include a butterfly valve.

9. A method to control flow of fluid to one or more high-pressure pumps of a hydraulic fracturing system, the method comprising:

determining, by a control system, a target flow rate for the fluid supplied to the one or more high-pressure pumps, the fluid including proppant and the target flow rate being sufficient to maintain the proppant in solution within the one or more high-pressure pumps;

determining, by the control system, a valve apparatus actuation scheme based on the target flow rate; the valve apparatus actuation scheme indicating a state for individual valve apparatuses of a number of valve apparatuses of the one or more high-pressure pumps to achieve a minimum flow rate of the fluid through the one or more high-pressure pumps to maintain the proppant in solution within the one or more high-pressure pumps, wherein a fluid and power delivery system is coupled between the one or more high-pressure pumps and a fluid source such that the fluid and power delivery system delivers the fluid to the one or more high-pressure pumps from the fluid source; and sending, by the control system, an actuation signal to the individual valve apparatuses to actuate a flow control member of the individual valve apparatuses.

10. The method of claim 9; further comprising:

receiving, by the control system, data from a number of sensor devices of a pump system included in the hydraulic fracturing system, the pump system including the one or more high-pressure pumps and the number of valve apparatuses; and analyzing, by the control system, the data to determine a current flow rate of the fluid supplied to the one or more high-pressure pumps.

11. The method of claim 10; further comprising:

analyzing, by the control system, the current flow rate with respect to a flow rate threshold;

determining; by the control system; that the current flow rate is outside of the flow rate threshold; and determining, by the control system; a modified valve apparatus actuation scheme based on a difference between the current flow rate and the target flow rate.

12. The method of claim 11; wherein:

the current flow rate is less than the minimum flow rate; and the modified valve apparatus actuation scheme indicates changes to the state of one or more individual valve apparatuses of the number of valve apparatuses of the pump system to cause the current flow rate to increase above the minimum flow rate.

13. The method of claim 11, wherein:

the flow rate threshold corresponds to a maximum flow rate for the fluid supplied to the one or more high-pressure pumps;

the current flow rate is greater than the maximum flow rate; and the modified valve apparatus actuation scheme indicates that an additional state of an additional valve apparatus of the number of valve apparatuses is to be modified from closed to open.

14. The method of claim 9, wherein the target flow rate is based on a demand of the one or more high-pressure pumps to deliver the fluid to a wellhead and the demand is based on a stage of a hydraulic fracturing operation that is being performed by the hydraulic fracturing system.

15. The method of claim 14, wherein the target flow rate corresponds to a first stage of the hydraulic fracturing operation, and the method further comprising:

determining an additional target flow rate for the fluid supplied to the one or more high-pressure pumps, the additional target flow rate corresponding to a second stage of the hydraulic fracturing operation.

16. The method of claim 9, wherein the fluid includes water and the proppant and the target flow rate corresponds to a flow rate such that the proppant stays in the water as the fluid is supplied to the one or more high: pressure pumps.

17. The method of claim 9, wherein the valve apparatus actuation scheme indicates a location of the individual valve apparatuses within the hydraulic fracturing system.

18. A pump system to supply fluid to a wellhead of a hydraulic fracturing system, the pump system comprising:

a high-pressure pump;

a plurality of valve apparatuses, individual valve apparatuses of the plurality of valve apparatuses including a signal receiving unit to receive signals to actuate a respective flow control member of the individual valve apparatuses according to a valve apparatus actuation scheme that indicates a state for the individual valve apparatuses to achieve a minimum flow rate of the fluid through the high-pressure pump to maintain proppant of the fluid in solution within the high-pressure pump; and a control system to determine a target flow rate sufficient to maintain the proppant of the fluid in solution within the high-pressure pump;

wherein the fluid is delivered to the pump system via a fluid and power delivery system, the fluid and power delivery system being coupled between a fluid source and the pump system.

19. The pump system of claim 18, wherein a valve apparatus of the plurality of valve apparatuses is configured to:

actuate the flow control member of the valve apparatus to enable a first flow rate through the valve apparatus based on one or more first signals received by the valve apparatus; and actuate the flow control member of the valve apparatus to enable a second flow rate that is different from the first flow rate through the valve apparatus based on one or more second signals received by the valve apparatus.

20. The pump system of claim 18, wherein the fluid and power delivery system includes a number of first inlet ports to deliver fluid to the high-pressure pump via one or more first fluid transmission lines and a number of outlet ports to receive fluid from the high-pressure pump via one or more second fluid transmission lines; and wherein the plurality of valve apparatuses are included in a fluid communication system of the pump system that includes a number of second inlet ports coupled to the one or more first fluid transmission lines, the number of second inlet ports including respective valve apparatuses of the plurality of valve apparatuses to supply the fluid to the high-pressure pump.

* * * * *